US005242188A

United States Patent [19]

Bigler et al.

[11] Patent Number: 5,242,188

[45] Date of Patent: Sep. 7, 1993

[54] MOVEABLE PLATE ASSEMBLY FOR SKI BINDING SUPPORT

[75] Inventors: Hans-Peter Bigler, Lutschenstrasse 15, CH-3063 Ittigen; Beat Dütsch, Schliern, both of Switzerland

[73] Assignee: Hans-Peter Bigler, Switzerland

[21] Appl. No.: 761,895

[22] PCT Filed: Dec. 27, 1990

[86] PCT No.: PCT/CH90/00293

§ 371 Date: Sep. 11, 1991

§ 102(e) Date: Sep. 11, 1991

[87] PCT Pub. No.: WO91/10485

PCT Pub. Date: Jul. 25, 1991

[30] Foreign Application Priority Data

Jan. 11, 1990 [EP] European Pat. Off. ..... 90810027

[51] Int. Cl.[5] ..... A63C 9/08

[52] U.S. Cl. ..... 280/618; 280/607

[58] Field of Search ..... 280/602, 607, 614, 618, 280/636, 620, 633

[56] References Cited

U.S. PATENT DOCUMENTS

| | | | |
|---|---|---|---|
| 3,797,844 | 3/1974 | Smolka et al. | 280/607 X |
| 4,139,214 | 2/1979 | Meyer | 280/607 |
| 4,294,460 | 10/1988 | Kirsch | 280/607 |
| 4,500,108 | 2/1985 | Johnson, III | 280/614 |
| 4,896,895 | 1/1990 | Bettosini | 280/607 |

FOREIGN PATENT DOCUMENTS

| | | | |
|---|---|---|---|
| 266662 | 11/1968 | Australia | 280/614 |
| 371730 | 7/1983 | Austria . | |
| 2346182 | 10/1974 | Fed. Rep. of Germany | 280/618 |
| 2215251 | 12/1974 | France . | |
| 2344306 | 10/1977 | France | 280/618 |
| 2492670 | 4/1982 | France | 280/614 |
| 573759 | 3/1976 | Switzerland . | |
| 637299 | 7/1983 | Switzerland . | |
| 83/03360 | 10/1983 | World Int. Prop. O. | 280/602 |

*Primary Examiner*—Brian Johnson

*Attorney, Agent, or Firm*—Ostrolenk, Faber, Gerb & Soffen

[57] ABSTRACT

A ski binding support (2) comprises a securing piece (8) which is fixedly connected to the ski (1) and serves for securing one end of a support plate (7) with the ski binding mounted thereon, and a guiding piece (9) which is also fixedly connected to the ski and wherein the other end of the support plate (7) is guided in a longitudinally freely movable manner. The support plate (7) is formed of a cover plate (17) having two narrowed, offset tongues (21, 22) which extend into the securing piece (8) and into the guiding piece (9), respectively. A base plate (18) disposed below support plate (7) rests upon the upper surface of the ski. The support plate with a ski binding mounted thereon, is easily and quickly detachable and attachable to the ski while conserving the bending capacity thereof in that there is free longitudinal guidance at one end of support plate (17). A rubber shock absorber interposed between support plate (7) and base plate (18) results in a substantial reduction of shocks imparted to a ski boot attached to the binding.

17 Claims, 2 Drawing Sheets

MOVEABLE PLATE ASSEMBLY FOR SKI BINDING SUPPORT

BACKGROUND OF THE INVENTION

The present invention refers to a ski binding support, comprising a support plate on which a ski binding is attachable, and means which are mounted on the ski in order to removably secure said support plate.

RELATED ART

A ski binding support of the general type is known from CH-A-637,299, where the support plate is held by three mouth-shaped grooves and is provided with a spring which mainly serves as a formfitting and force-transmitting attachment to the ski.

Due to the increasing popularity of skiing, on one hand, the growing prosperity and especially the technical improvements and refinements, on the other hand, there is a growing number of people who own more than one pair of skis in order to be able, according to the particular conditions, to use the appropriate ski. Moreover, ski resorts have a considerable number of shops where skis can be rented, providing an opportunity for customers to try different skis. These circumstances lead to an increasing need to reduce costs, of which ski bindings represent a major factor. Purely theoretically, the abovementioned ski binding support might provide an answer. Recent developments have shown, however, that a formfitting attachment of the ski binding to the ski is undesirable in many cases as it impairs the resilience of the ski. Thus, there are now ski bindings where the heel portion of the binding is connected by means of a flexible ribbon in order to avoid any stiffening of the ski. In such a case, however, the binding is directly mounted to the ski. This system is described in AT-B-371,730.

SUMMARY OF THE INVENTION

With the foregoing as a background, it is a first object of the present invention to provide a ski binding support which is not only easily exchangeable in order to be mounted on various skis but also allows the flexibility of the skis to be fully conserved. This object is attained by a ski binding support as illustrated in the accompanying drawings and the following description of same. A preferred embodiment provides a solution to the task of absorbing shocks which are imparted to the ski boots and thus to the skier. This problem is solved in that said support plate comprises a rubber-elastic shock absorber. The use of shock absorbers is know, as shown in EP-B-104,185, where a shock absorber is fixedly cemented above its entire surface between the ski and a non-exchangeable ski binding.

BRIEF DESCRIPTION OF THE DRAWINGS

The invention is explained in more detail hereinafter with reference to the accompanying drawings in which:

FIG. 1 shows ski 1, ski binding support 2 of the invention, as well as toe portion 3 and stopper 4, 5 of binding 6, which is mounted to the support plate 7 in exactly the same manner as when attached directly to a ski.

DETAILED DESCRIPTION OF THE DRAWINGS

The first embodiment of the ski binding support of the invention illustrated in FIGS. 1 to 5, is composed essentially of three parts: support plate 7, securing piece 8 at the front, and the guiding piece 9 at the back. As opposed to the previously mentioned binding having a heel portion which is flexibly connected to the ski, reference is here made to a support plate 7, and it is therefore possible as well to provide the securing piece at the back, near the heel, and the guiding piece at the front, since it is only essential that a relative displacement of the support plate 7 with respect to the ski 1 is possible.

Figure 4:
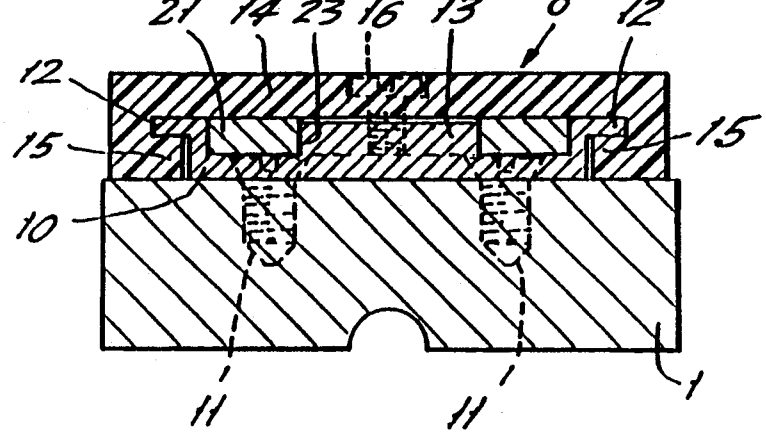
FIG. 4 shows a transverse cross-section through line IV—IV in FIG. 2.

Securing piece 8, see also FIG. 4, comprises a U-shaped securing rail 10 which is fixedly connected to the ski by means of four screws 11. The walls of the U-shaped securing rail 10 comprise a web with arms which have angled ends 12 which extend in parallel to the ski surface. A protrusion or peg 13 is disposed in the center of the securing rail. A cover 14, e.g. of plastics material or aluminum, is slid over said securing rail, the longitudinal sides 15 of said cover engaging behind angled ends 12, and said cover 14 being attachable to the securing rail by means of a securing screw 16. Instead of a screw, a snap means may be provided as well.

In the present embodiment, support plate 7 is formed of a cover plate 17 and a base plate 18 between which a rubber-elastic shock absorber 19 is disposed.

Figures 1, 2, 3:
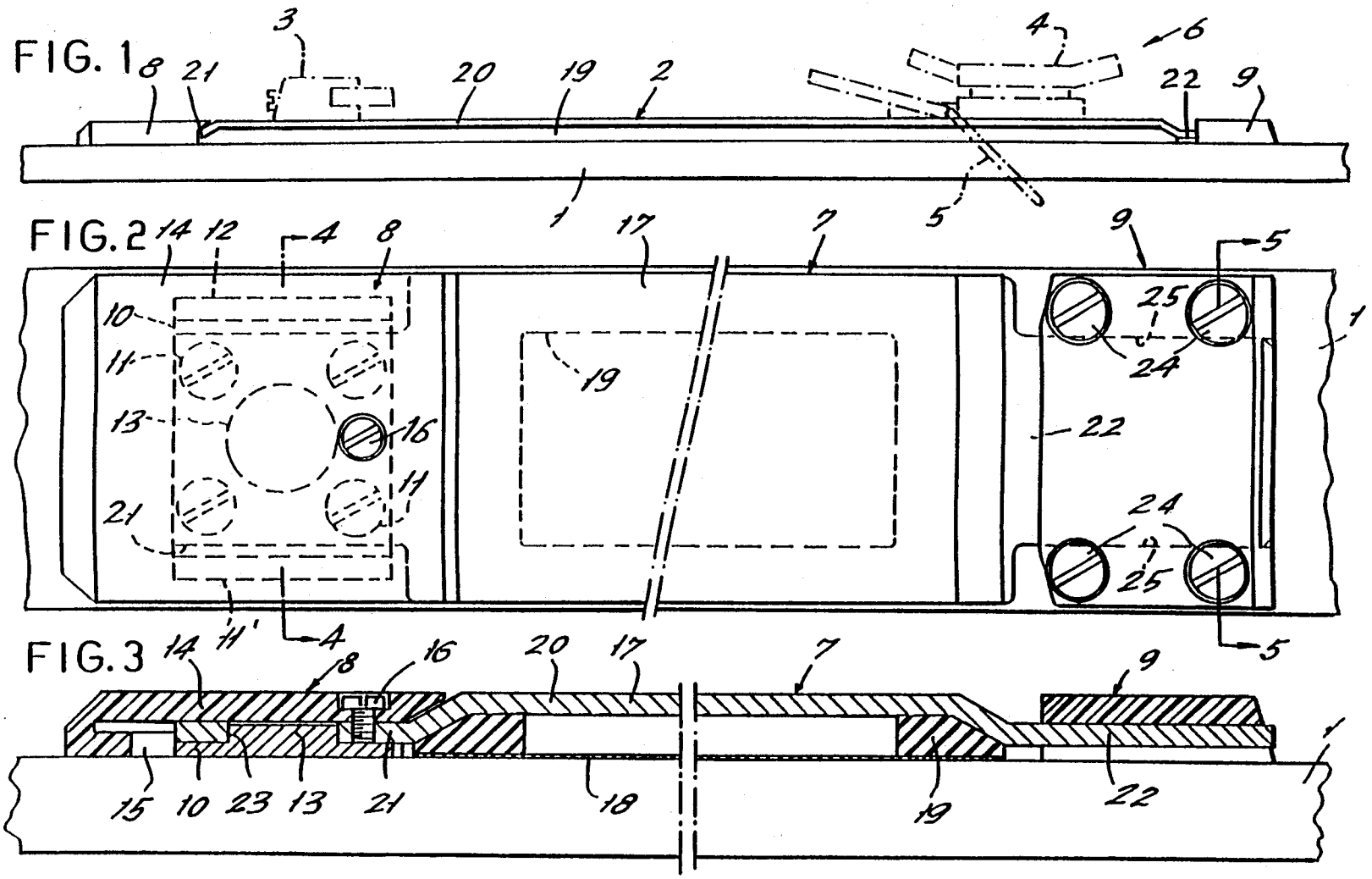
FIG. 1 shows a schematical side view of a ski binding support according to the invention with a ski binding mounted thereon.
FIG. 2 shows the ski binding support of the invention from above.
FIG. 3 shows a longitudinal cross-section of the ski binding support according to FIG. 2.
Figure 5:
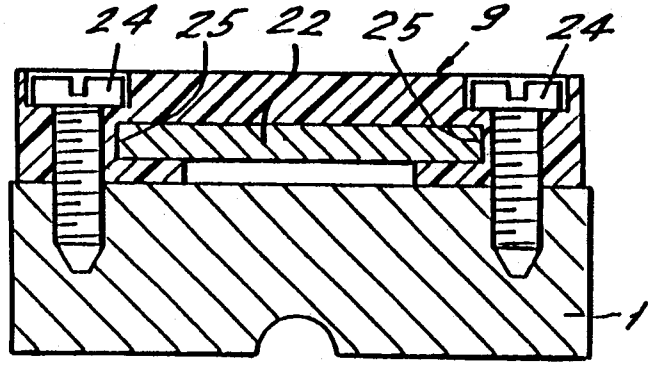
FIG. 5 shows a transverse cross-section through line V—V in FIG. 2.

As shown especially in FIGS. 2 and 3, cover plate 17 consists of a center portion 20 an two narrowed, cranked tongues 21 and 22 at the front and at the back, respectively. Front tongue 21 is provided with an opening 23 corresponding to peg 13. An opening for peg 13 need not necessarily be cylindrical. It appears in FIGS. 2 and 3 that rubber-elastic shock absorber 19 has a rectangular frame-shaped configuration. Base plate 18 is preferably made of a low-friction plastics material such as the material known under the tradename TEFLON, in order to facilitate the gliding movement of the support plate 7 upon the ski surface.

Rearward tongue 22 is fitted (see especially FIG. 5) in a longitudinally displaceable manner in rearward guiding piece 89 which is fixedly connected to the ski by means of four screws 24. The sidewalls of rearward guiding piece 9 are provided with a respective guideway 25 each in order to receive the rearward tongue, said guiding piece 9 being manufactured from a suitable plastics material.

Aluminum as well as plastics materials are suitable as materials for cover plate 17. If plastics material is used for the cover plate, it is advantageous to provide longitudinal ribs in order to increase the torsional stability. The stability is further increased by the use of glass or carbon fibre-reinforced plastics materials.

In order to attach the support plate 7 which the mounted ski binding support 2 to the ski it is sufficient to insert the plate 7 into the guiding piece 9 by rearward tongue 22 and to place opening 23 of the front tongue 21 upon peg 13. Plastics cover 14 is then slid onto the securing rail 10 and secured by means of securing screw 16. Altogether this allows a very easy and quick attachment of the support plate 7 with the ski binding 6 to the ski 1. According to the intended use, e.g. as private skis or rental skis, the securing screw 16 may be operated by a coin or a screwdriver or alternatively, if an easy removal is not desired, a hexagon socket screw or another exclusive screw may be used instead of the illustrated screw, said screw being operable by a special tool only. It is possible in the represented example to remove the support plate, or e.g. just the support plate of one ski, and to carry ti along in order to render the skis unattractive for thieves.

The binding support of the invention not only allows an easy changeover of the bindings 6 to other skis which are provided with the attaching means, whereby considerable expenses for the bindings on other skis are saved, but also a substantial gain in skiing quality due to the longitudinally freely displaceable end of the binding, whereby the original resilience of the ski is conserved, on one hand, and through the use of a rubber-elastic shock absorber, on the other hand, in order to absorb shocks imparted to the ski boots and thus to the skier. Moreover, the present system allows a removal of the ski binding for transport, which is especially significant if the skis are transported on a rooftop carrier by private car as the bindings are very delicate with respect to soiling, which occurs especially during driving if the skis are not protected by a ski bag. Besides, it is favorable with respect to the aerodynamics of the skis on the ski carrier if the bindings are dismounted.

Moreover, the use of the ski binding support of the invention allows an adjustment of the bindings without the skis, which is a great simplification especially if the transport is not effected by car.

Figure 6:
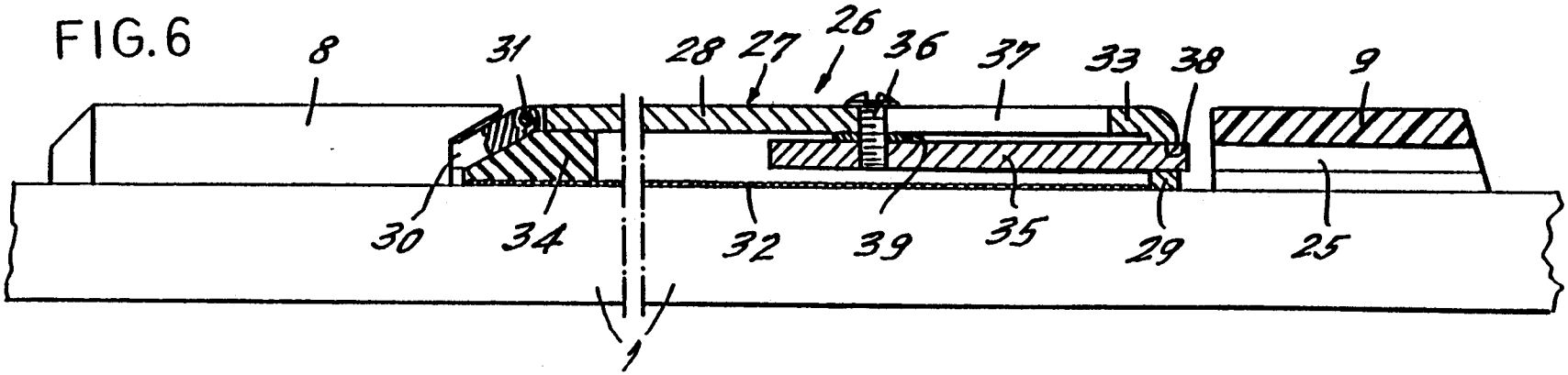
FIG. 6 shows a longitudinal cross-section for an alternative embodiment of the ski binding support of the invention for a touring binding.

The list of the above-described advantages can be considerably enlarged if the alternative embodiment according to FIG. 6 is added. This alternative embodiment refers to a ski binding support for touring skis, which must provide the possibility of lifting the feet. Ski bindings for touring skis are known where the ski binding can be set by means of complicated mechanisms, either to a touring position or to a downhill position. In the present embodiment according to FIG. 6, this is achieved by the illustrated ski binding support 26. Securing piece 8, which can only be disposed at the front in this case, as well as the rearward guiding piece 9 are identical to those of the previously described embodiment. The support plate, however, is different from support plate 7 of the first embodiment. Support plate 27 is composed of a center portion 28 which ends in downwardly angled portion or piece 29 at the back and is provided with the same cranked tongue 30 as in the previous example, the first bend comprising an articulation 31, however. Here also, the base plate 32 is made of a low-friction plastics material, and a rubber-elastic shock absorber 34 is interposed between said base plate and cover plate 33 as well. A blocking tab 35 is slidably mounted underneath the rear part of cover plate 33, at least the very front portion of said tab having the same configuration as the rearward tongue 22 of the first embodiment. As illustrated rather schematically, tab 35 is held in the cover plate 33 by means of a locking screw 36 which is displaceable in a slot 37 of the cover plate 33, and moreover guided in a corresponding opening 38 of angled portion 29. A washer 19 is disposed between tab 35 and the underside of the cover plate 33. In the position as shown in FIG. 6, the ski binding support is mounted in the touring position, i.e. support plate 27 is pivotable around articulation 31, whereby walking with the skis is possible. For downhill skiing, the tab 35 is pushed into guiding piece 9 and the screw 26 is tightened, whereby the binding support and thus the binding fulfills the same function as in the first example for regular downhill use. The possible applications of the ski binding support according to the invention are substantially augmented by the use of this detachable touring binding.

We claim:

1. A ski binding support including;

an elongated support plate having opposed ends to which a ski binding is attachable, and means for removably mounting said support plate on a ski;

said means including a securing piece and a guiding piece, both of said pieces being fixedly mounted on said ski and spaced longitudinally therealong;

said securing piece removably engaging said support plate at one end thereof, said securing piece having means for slidably and removably engaging said one end and having cooperating formulations that prevent movement of said one end in a longitudinal direction relative to said ski;

said guiding piece removably engaging said support plate at the other end, said guiding piece and said other end having cooperating formations that permit relative longitudinal movement between said other end of said support plate and said ski; and wherein, when both said means for slidably and removably engaging and said support plate are disengaged, said securing piece and said guiding piece remain fixedly mounted on said ski.

2. A ski binding support as in claim 1 in which at least one of said securing piece and said guiding piece includes a shallow U-shaped securing rail that receives an end of said support plate.

3. A ski binding support as in claim 1 in which said securing piece includes a shallow U-shaped securing rail that receives said one end of said support plate and said guiding piece is U-shaped to slidably receive said other end of said support plate.

4. A ski binding support as in claim 2 in which said U-shaped securing rail includes a wall comprising a web and arms extending upward from opposite ends of said web, an upward protrusion disposed between said arms and received by a cutout in said support plate.

5. A ski binding support as in claim 4 in which said securing piece includes said U-shaped securing rail and said means for slidably and removably engaging comprises a slidable cover for said U-shaped securing rail, said cover when mounted on said U-shaped securing rail prevents movement of said one end of said support plate to retain said protrusion disposed within said cutout.

6. A ski binding support as in claim 2 in which said U-shaped securing rail includes a web, and an arm disposed at each end of said web, each of said arms having an angled free end, said web being adjacent said support plate.

7. A ski binding support as in claim 3 in which said U-shaped securing rail of said securing piece includes a web and arms extending upward from opposite ends of said web, and an upward protrusion disposed between said arms which is received by a cutout in said one end of said support plate; and said U-shaped guiding piece having two opposed sidewalls, said sidewalls defining a guideway, and said other end of said support plate being slidable within said guideway.

8. A ski binding support as in claim 1 in which said securing piece includes a shallow U-shaped securing rail having angled ends;

said rail being mountable on a ski and being provided with a peg that is centered transversely on a ski when said rail is mounted thereon;

said means for slidably and removably engaging said one end of said support plate of said securing piece comprises a securable slide-one cover;

said guiding piece being mountable on said ski longitudinally spaced from said rail and including spaced sidewalls defining a guideway;

first and second narrowed tongues at opposite ends of said support plate;

said first tongue being fitted into said securing piece and having a cutout wherein said peg is disposed; and said second tongue being fitted into said guiding piece.

9. A ski binding support as in claim 8 in which the support plate includes an elongated central portion, said tongues extending in opposite directions from said central portion and being offset downwardly therefrom.

10. A ski binding support as in claim 8, adapted for use with a touring ski, in which the support plate includes a central portion having opposed ends;

pivot means connecting said first tongue to said central portion at one end thereof;

said second tongue being connected to said central portion at the other end and being slidable longitudinally with respect thereto between an extended position wherein the second tongue is fitted into said guiding piece and a retracted position wherein the second tongue is disengaged from said guiding piece to permit said other end of said central portion to move toward and away from said ski about said pivot means; and wherein said first and second tongues when fitted into said securing piece and said guiding piece, respectively, extend in opposite directions from said central portion.

11. A ski binding support as in claim 8 in which the cover and the guiding piece are constructed of plastics material.

12. A ski binding support as in claim 1 in which said support plate includes an elongated cover plate, an elongated base plate below said cover plate, and an elongated elastomeric shock absorber disposed between said cover plate and said base plate.

13. A ski binding support as in claim 12 in which the base plate is constructed of a low-friction plastics material, and the shock absorber has a centrally open frame-like configuration.

14. A ski binding support as in claim 12 in which said cover plate is constructed of aluminum.

15. A ski binding support as in claim 12 in which said cover plate is constructed of plastics material.

16. A ski binding support as in claim 12 in which said cover plate is constructed of fibre reinforced plastics material.

17. A ski binding support as in claim 1 in which said other end is brought into removable engagement with said guiding piece by longitudinal movement of said support plate; and said securing piece includes a releasable fastening means for maintaining said support plate and said securing piece removably engaged to each other.

* * * * *

UNITED STATES PATENT AND TRADEMARK OFFICE

CERTIFICATE OF CORRECTION

PATENT NO. : 5,242,188

DATED : Sept. 7, 1993

INVENTOR(S) : Hans-Peter Bigler et al.

It is certified that error appears in the above-indentified patent and that said Letters Patent is hereby corrected as shown below:

In the Claims:

Column 4:

Claim 1, line 24, change "formulations" to --formations--.

Signed and Sealed this

Twelfth Day of April, 1994

*Attest:*

Bruce Lehman

BRUCE LEHMAN

*Attesting Officer*

*Commissioner of Patents and Trademarks*